United States Patent [19]

Braddick

[11] Patent Number: 5,036,922

[45] Date of Patent: Aug. 6, 1991

[54] SINGLE PLUG ARRANGEMENT, LOCK THEREFOR AND METHOD OF USE

[75] Inventor: Britt O. Braddick, Houston, Tex.

[73] Assignee: Texas Iron Works, Inc., Houston, Tex.

[21] Appl. No.: 501,555

[22] Filed: Mar. 30, 1990

[51] Int. Cl.[5] ..... E21B 23/04; E21B 33/126; E21B 33/14; E21B 33/16

[52] U.S. Cl. ..... 166/383; 166/156; 166/181; 166/202; 166/387

[58] Field of Search ..... 166/153, 155, 156, 291, 166/181, 123, 382, 383, 386, 387, 192, 202

[56] References Cited

U.S. PATENT DOCUMENTS

| | | | |
|---|---|---|---|
| 3,223,170 | 12/1965 | Mott | 166/208 |
| 3,364,996 | 1/1968 | Brown | 166/120 |
| 3,472,520 | 10/1969 | Burns | 277/116.2 |
| 3,545,542 | 12/1970 | Scott | 166/155 |
| 3,635,288 | 1/1972 | Lebourg | 166/156 |
| 3,777,819 | 12/1973 | Delano | 166/285 |
| 3,796,260 | 3/1974 | Bradley | 166/153 |
| 3,915,226 | 10/1975 | Savage | 166/153 |
| 3,920,075 | 11/1975 | Braddick et al. | 166/290 |
| 3,993,128 | 11/1976 | Braddick | 166/216 |
| 4,010,804 | 3/1977 | Garcia | 166/208 X |
| 4,042,014 | 8/1977 | Scott | 166/154 X |
| 4,047,566 | 9/1977 | Duke | 166/285 |

(List continued on next page.)

OTHER PUBLICATIONS

"RP Liner Setting Assembly Used for Rotate & Reciprocate Cementing", Texas Iron Works, Inc., 80-81 Catalog, p. 6850.

"RRP Liner Setting Assembly for Extended Rotation", Texas Iron Works, Inc., 1982-83 Catalog, p. 7914.

C. R. Hyatt and M. H. Partin, Jr., "Liner Rotation and Proper Planning Improve Primary Cementing Success", Texas Iron Works, Inc., SPE 12607 Reprint, SPE Deep Drilling and Production Symposium, Amarillo, Tex., Apr. 1-3, 1984.

Juan A. Garcia, "Rotating Liner Hanger Helps Solve Cementing Problems", reprinted by Petroleum Engineer International, Sep. 1985 expressly for Texas Iron Works, Inc.

API Bulletin D17, "Running and Cementing Liners in the Delaware Basin, Tex.", First Edition, Dec. 1974.

H. Ed Lindsey, "Liner Cementing Equipment and Techniques", Southwestern Petroleum Short Course Association, 1977.

H. E. Lindsey, Jr., "New Tools Make Liner Rotation During Cementing Practical", reprinted from World Oil, Oct. 1981.

H. E. Lindsey, Jr., "Recent Developments in Tools for Liner Movement During Cementation", Southwestern Petroleum Short Course Association, 1981.

(List continued on next page.)

*Primary Examiner*—Stephen J. Novosad

*Attorney, Agent, or Firm*—Jack W. Hayden

[57] ABSTRACT

A single wiper is releasably and sealably positioned adjacent the lower end an operating string and locked therewith to prevent premature release from the operating string upon manipulation of the operating string. The sealing relationship between the wiper and the operating string prevents communication of operating string pressure from the operating string to the resilient ribs of the wiper adjacent the position of the wiper on the operating string. When a pump down plug is sealably seated within the bore of the wiper, fluid pressure is confined to act on a piston between the operating string and the wiper to unlock the wiper from the operating string so that it may be released therefrom.

38 Claims, 3 Drawing Sheets

U.S. PATENT DOCUMENTS

| | | | |
|---|---|---|---|
| 4,060,131 | 11/1977 | Kenneday et al. | 166/125 X |
| 4,281,711 | 8/1981 | Braddick et al. | 166/118 |
| 4,562,889 | 1/1986 | Braddick | 166/381 |
| 4,624,312 | 11/1986 | McMullin | 166/155 |
| 4,671,358 | 6/1987 | Lindsey, Jr. et al. | 166/291 |
| 4,688,642 | 8/1987 | Baker | 166/382 |
| 4,809,776 | 3/1989 | Bradley . | |
| 4,836,279 | 6/1989 | Freeman | 166/153 |
| 4,842,069 | 6/1989 | Baugh et al. | 166/291 X |
| 4,934,452 | 6/1990 | Bradley | 166/291 |

OTHER PUBLICATIONS

W. T. Lee and W. D. Dorge, "Cementing—Simultaneous Rotation—Reciprocating Technique (ROTO-TEK System)", IADC/SPE 11419, IADC/SPE 1983 Drilling Conference, New Orleans, La., Feb. 20-23, 1983.

W. R. Landrum and R. D. Turner, "Rotating Liners During Cementing in the Grand Isle and West Delta Area", IADC/SPE 11420, IADC/SPE 1983 Drilling Conference, New Orleans, La., Feb. 20-23, 1983.

R. Buchan and M. T. S. Little, "Innovative Techniques Improve Liner Cementation in North Sea Wells: An Operator's Experience", SPE 15896, SPE European Petroleum Conference, London, Oct. 20-22, 1986.

M. A. Arceneaux and R. L. Smith, "Liner Rotation While Cementing: An Operator's Experience in South Texas", SPE/IADC 13448, SPE/IADC 1985 Drilling Conference, New Orleans, La., Mar. 6-8, 1985.

H. E. Lindsey, Jr., "Rotate Liners for a Successful Cement Job", World Oil, Oct. 1986, pp. 39, 40, 43.

H. E. Lindsey, Jr. and K. S. Durham, "Field Results of Liner Rotation During Cementing", SPE 13047, 59th Annual Technical Conference and Exhibition, Houston, Tex., Sep. 16-19, 1984.

Joe Gibbs, "How to Rotate and Reciprocate While Cementing Your Liner", Drilling—DCW, Jun. 1974.

James L. Cowthran, "Technology Used to Improve Drilling Performance and Primary Cementing Success in Katy Field", SPE 10956, 57th Annual Fall Technical Conference and Exhibition, New Orleans, La., Sep. 26-29, 1982.

Kyle S. Graves, "Planning Would Boost Liner Cementing Success", Technology, Apr. 15, 1985, Oil and Gas Journal.

Rod Bennett, "Tapered Roller Bearing Enhances Rotating Liner Hanger Performance", Sep. 1985.

SINGLE PLUG ARRANGEMENT, LOCK THEREFOR AND METHOD OF USE

CROSS REFERENCE TO RELATED APPLICATIONS

The present patent application relates to co-pending application Ser. No. 07/348,221 filed May 9, 1989 for "Cementing Method and Arrangment", now U.S. Pat. No. 4,966,236, a continuation of applicant's prior co-pending application Ser. No. 07/147,701 filed Dec. 4, 1987, now abandoned; co-pending application Ser. No. 07/471,291 filed Feb. 1, 1990 for "Arrangement and Method for Conducting Substance and Seal Therefor;" and co-pending application Ser. No. 07/471,292 filed Feb. 1, 1990 for "Arrangement and Method for Conducting Substance and Lock Therefor."

STATEMENT OF THE PRIOR ART

Prior to the above cross referenced inventions, substantial difficulty was encountered at times in attempting to employ tandem wipers and tandem plugs in operations for conducting a substance, such as by way of example only, cement, through an operating string for discharge into a well bore. For example, when a liner is lowered into a well bore on an operating string for positioning or hanging on a casing in a well bore, it is customary to cement the liner in the well bore. Also, in mining or other operations, it may be desirable also at times to conduct a substance into the well bore and to isolate it as it is conducted into the well bore so that it is discharged at the desired location in the well bore.

In prior cementing operations the problems associated with the use of tandem wipers and their plugs was such that in many instances a single plug system was used. Where as single or tandem plug system is used, a liquid barrier is generally first discharged into the operating string that extends to the earth's surface on which the liner that is to be hung is supported, and thereafter a sealing agent, such as cement, is discharged into the operating string. After the desired volume of cement has been discharged into the operating string, a liquid barrier is positioned in the operating string behind the volume of cement and after the liquid barrier is inserted in the operating string, a pump down plug with resilient ribs is inserted into the operating string and pumped down as the cement and liquid barriers are pumped down the operating string to be discharged into the well bore around the liner in a well known manner and for well known reasons. The liquid barriers and plug isolate the cement and the plug ribs wipe the operating string. This single plug seats in the single wiper secured to a tail pipe on and depending from the lower end of the operating string. The wiper that is connected on the tail pipe is provided with resilient ribs projecting outwardly therefrom and when the single plug seats therein, the plug and wiper are sealably connected together and are released from the operating string so that the wiper ribs wipe the liner and the plug seated in the wiper assists in isolating above the slug of cement.

Heretofore, there has not been any means to prevent premature separation or release of a single plug from the well string as the well string is manipulated during cementing operations either by rotation or reciprocation.

SUMMARY OF THE INVENTION

The present invention relates to an apparatus and its method of use to lock a single plug wiper to an operating string so as to prevent premature release of the wiper if the operating string is rotated and/or reciprocated or otherwise manipulated relative to the liner.

An object of the present invention is to provide a single wiper having a tubular body with a bore therethrough for connection with an operating string having a bore therein whereby cement or any desired substance may be conducted through an operating string and the wiper with a slug of liquid in front of the cement and a slug of liquid behind the cement to assist in isolating the cement. Lock means locks the wiper to the operating string so that it will not release in response to manipulation of the operating string but will release solely in response to fluid pressure in the operating string. This enables the operating string to be manipulated as desired without fear of premature release of the wiper causing a malfunction of the cementing operation or while conducting other substances into the well bore.

Other objects and advantages of the present invention will become readily apparent from a consideration of the following description and drawings.

DESCRIPTION OF THE PREFERRED EMBODIMENTS

Figure 1:
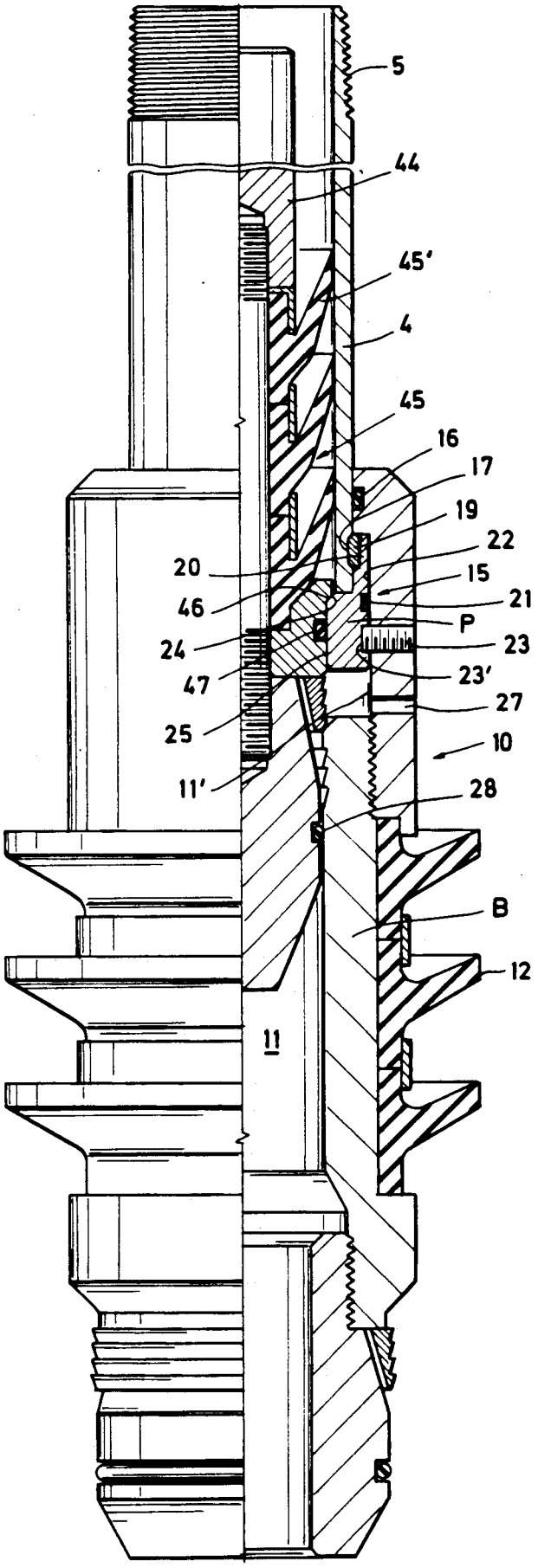
FIG. 1 is a quarter-sectional view of one embodiment of the wiper invention illustrating a pump down plug positioned therein.
Figure 3:
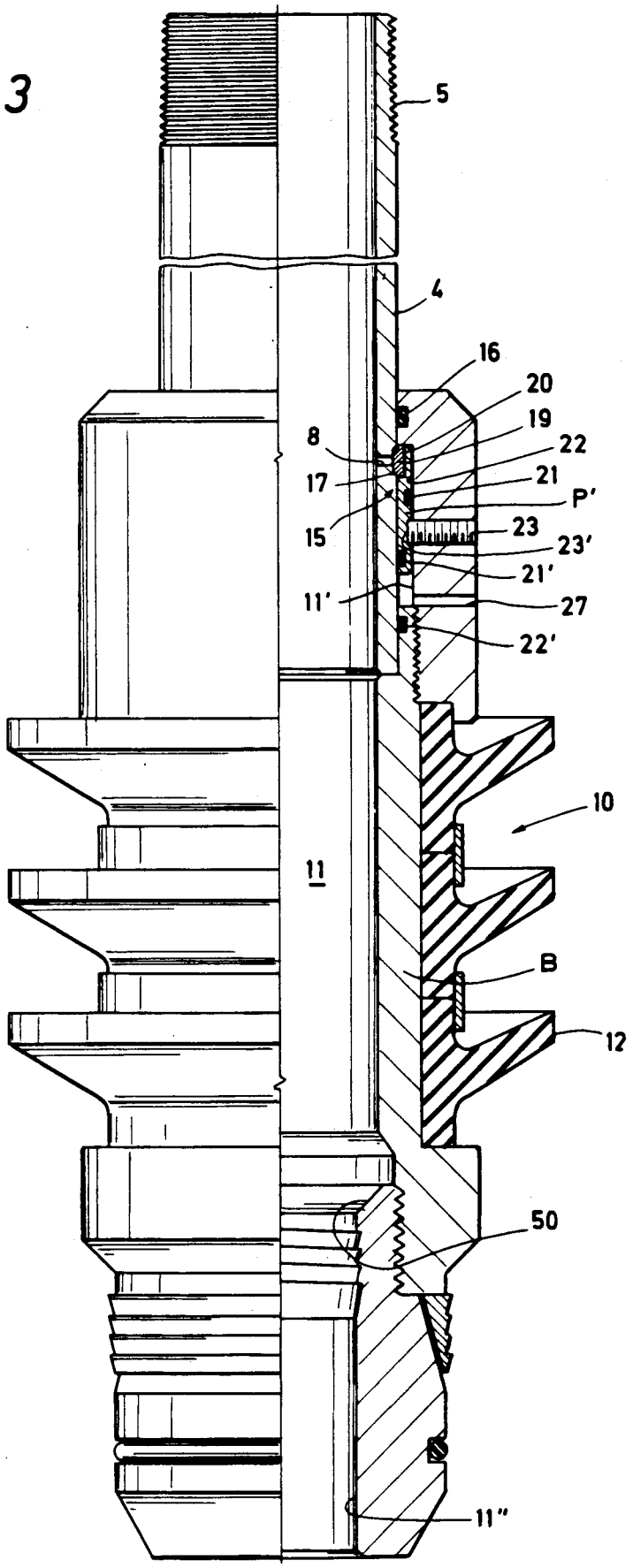
FIG. 3 is a quarter-sectional of still another form of the invention.

Attention is first directed to FIG. 1 of the drawings wherein the preferred embodiment is shown. A tubular tail pipe 4 is provided with threads 5 at its upper end for connection to and to form it as part of the operating string (not shown) that extends upwardly to the earth's surface as well known in the art. For all practical purposes the tail pipe 4 may be considered as part of the operating string. It will be noted that a wiper referred to generally by the numeral 10 is supported adjacent the lower end of the tail pipe 4 of the operating string and such wiper includes a tubular body B having a longitudinal bore 11 extending therethrough. A plurality of resilient ribs 12 are mounted on the outside of the body B and extend outwardly therefrom as illustrated in the drawings. In FIGS. 1 and 3 the tail pipe 4 of the operating string extends longitudinally into the bore 11 of the body B as shown in the drawings, and means to lock the operating string with the body B of the wiper are referred to generally by the numeral 15. A seal 16 is provided between the wiper body B and the exterior surface of the operating string tail pipe to assist in preventing communication from the bore of the operating string to the exterior of the wiper body after plug 45 has seated and sealed within the tail pipe 4 as shown in FIG. 1.

The lock means 15 includes annular piston means P that is positioned in the bore 11 of the body B of the wiper 10 in the embodiment shown in FIG. 1. An annular groove or recess 17 is formed on the exterior of the operating string tail pipe 4 in which recess is received an annular projection 19 which may be in the form of a split ring or the like. The piston P includes an end recessed portion 20 which in the position shown in FIG. 1 overlaps or overlays the annular projection 19, which may be in the form of a split ring, engaged in the recess 17 to lock the operating string tail pipe 4 and the wiper body B against relative longitudinal movement. In the FIG. 1 embodiment, the piston means P is provided with a seal ring 21 for sealing between the piston and the inner annular surface 22 of the enlarged bore portion 11' in the wiper body B. Any suitable means may be employed to releasably retain the piston P releasably secured in locked position as shown in FIG. 1. One such means is illustrated as being in the form of frangible means such as a shear pin 23 connected in body B of wiper 10. However, it can e appreciated that other suitable release means may be employed such as an annular groove in the bore 11 with a split ring of sufficient strength to fit in the groove and a corresponding groove in the piston P or to abut the end of the piston P in a manner to prevent longitudinal movement thereof until the pressure in the operating string is sufficient to expand such ring into the recess and permit the piston P to move longitudinally and unlock the wiper 10 from tail pipe 4 as will be described. The release means 23, in whatever form, releasably secures piston P to wiper body B and operating string tail pipe 4 as shown in the drawings.

In the FIG. 1 embodiment, it will be noted that the pump down plug 45 is provided with a solid body 44; resilient ribs 45' extending outwardly therefrom to sealingly wipe the operating string as it moves therethrough to then sealingly engage with tail pipe 4 when the plug 45 seats in wiper 10; and an annular seat 46 on body 44 to engage on the annular seat 24 formed on the piston P.

Plug 45 is also provided with annular seal 47 supported on body 44 to seal on the interior or inner annular surface 25 of the piston P which defines a differential seal area responsive to fluid pressure in the operating string to effect unlocking of the lock means by shearing pin 23 which releases wiper 10 from the operating string.

In the FIG. 1 embodiment when the pump down plug 45 is seated as shown, the resilient ribs 45' thereon will wipingly engage within the operating string tail pipe and when the fluid pressure in the operating string is increased, the seals 16, 21, 47 and the seal 28 on the lower portion of body 44 of plug 45 confines the pressure in the operating string tail pipe and transmits the fluid pressure therein to act on the piston and effect shearing of the pin 23 so that the piston P can move down to permit release the split ring 19 from the tail pipe recess 17. A suitable port 27 in body B enables fluid pressure in the well bore and the operating string beneath piston 15 to be equalized after plug 45 is seated as shown in FIG. 1 so that downward movement of the piston P will not be restrained after the pin 23 is sheared to unlock piston P for longitudinal movement.

When the wiper 10 is unlocked from the operating string it may be pumped down the liner, or tubular member in the well bore, behind the liquid barrier that is above the cement therebeneath to discharge the cement into the well bore. The body B of the wiper is then captured in the lower end of the liner in a well known manner and if desired can be later milled to remove it from the liner.

Figure 2:
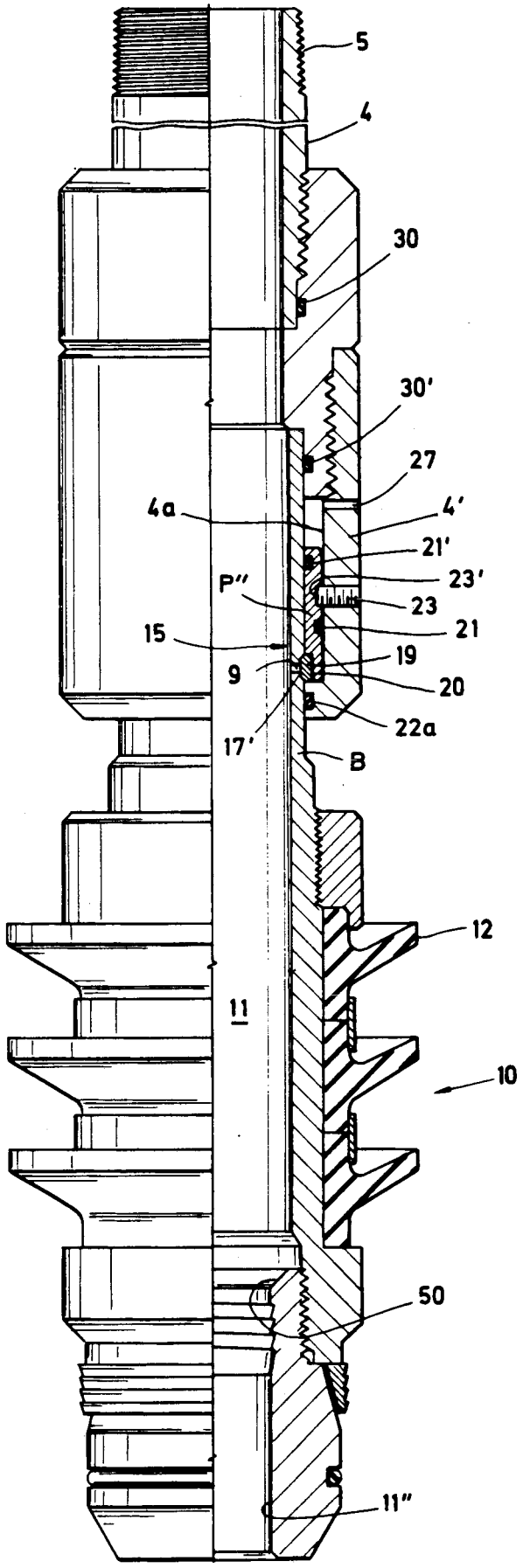
FIG. 2 is a quarter-sectional view of a altered embodiment of the invention.

In the FIG. 2 embodiment, like numerals are used to designate components that are like those shown in FIGS. 1 and 3. The body B of the wiper referred to generally at 10 is again shown provided with resilient ribs 12 as previously described.

In this form of the invention, the upper end of the wiper body B is provided with an exterior annular recess 17' for receiving the projection or ring 19 therein so that relative rotation may occur between the tail pipe 4 of the operating string without shearing pin 23 and thereby releasing wiper 10. The lock means is referred to generally at 15 and the release shear means is illustrated at 23 extending through tail pipe extension 4' for releasably retaining the piston P" locked in place in the enlarged bore **4*a* of the operating string tail pipe 4'. The piston P" includes a recessed end portion 20 which overlaps the projection 19 when it is in groove 17'. Seals 21 and 21' on the outer and inner diameter of annular piston P" seal, respectively, with the inner wall of the enlarged bore 4*a* and the exterior surface on wiper body 10 as illustrated in FIG. 2**.

Seals 30, 30', 21', 21 and **22*a* prevent leakage from tail pipe 4 to the well bore at its connection with wiper 10 after a pump down plug is seated by means of the seat 50 in the bore 11 of wiper 10. At the such time, a seal, such as the seal 28 on the body of the pump down plug, as shown in FIG. 1, is received within the bore 11" of the wiper 10 below port 9 to isolate or confine fluid pressure in the operating string so that it acts through port 9**.

An increase in pressure in the operating string is transmitted through the port 9 to act on the seals 21, 21' and **22*a* in a manner to shear the pin 23 and enable the piston P" to unlock from the tail pipe and move upwardly. When this occurs, the wiper is free to move away from the operating string as described with regard to the FIG. 1 embodiment. The port 27** equalizes pressure in the well bore with that above the piston and enables the piston P" to move upwardly.

In the FIG. 3 embodiment, like numerals are used to identify components that are the same as FIG. 1. A wiper 10 with resilient ribs 12 is locked to the operating string tail pipe 4 and body B of wiper 10 by lock means 15, such lock means being releasably secured to wiper 10 in the enlarged bore 11' of wiper 10 by means 23.

The piston P' of the lock means in the FIG. 3 form includes a recessed end portion 20 that overlays and supports the projection 19 that is received in groove 17 in the operating string tail pipe 4. Seals 21 and 21' on the outer and inner diameter of piston P', respectively, seal with the inner wall of the enlarged bore portion 11' in the wiper 10 and the exterior surface on the tail pipe.

Seals 16, 21, 21' and 22' prevent communication from the operating string tail pipe 4 to the well bore adjacent the location where the wiper 10 is connected to the tail pipe. A seal 28 on a pump down plug, as shown in FIG. 1, sealingly engages in the bore 11" of the wiper 10 below port 8 when the plug is seated on seat 50 in the wiper bore 11 so that fluid pressure in the operating string is confined to act through port 8 in tail pipe 4 on the differential seal are formed by seals 21, 21' and 16 and effect release of piston P' by shearing pin 23, as described with regard to the FIGS. 1 and 2 form. The pump down plug used with the FIG. 3 form, as well as the FIG. 2 form, will be modified to be received on seat 50, instead of seating on the piston as shown in FIG. 1.

The longitudinal position of seals 21, 21' on piston P" is reversed as compared with their position on piston P', but serve the same function as seals 21, 21' on piston P' in FIG. 3.

In the FIGS. 1 and 3 form, the piston P, P', respectively, remains with the wiper after it is unlocked from the operating string tail pipe 4. In the FIG. 2 embodiment, the piston P'' is recovered with the operating string and its tail pipe 4 after the wiper 10 is unlocked therefrom. The annular recess 17 and projection 19 accommodate relative rotation between the wiper body and the tail pipe. The shear pin 23 may be engaged in an annular recess 23' in the piston of each form so that relative rotation between the shear pin and piston can occur to inhibit actuation of the shear pin upon rotation of the operating string.

All three forms of the invention can be used with any seal arrangement that seals between the operating string and liner above the present invention and which arrangement is retrievable with the work string, such as a swab cup arrangement or a retrievable pack off bushing. The FIG. 2 form can not be used with a drillable pack off arrangement between the operating string and liner since the enlarged lower end extension 4' of the tail pipe can not be pulled through a drillable pack off for retrieval purposes. The FIGS. 1 and 3 form can be used with a drillable pack off seal arrangement since the operating string tail pipe 4 can be retrieved from the liner by being pulled therethrough.

As noted, the ports 27 in the FIGS. 2 and 3 permit equalized pressure between the well bore and the piston end with which the ports 27 communicate to accommodate longitudinal movement of the piston.

The annular recess 17 or 17' and projection 19 may be considered as part of the releasable securing means along with the means 23 for releasably securing the operating string and wiper together, as well as part of the lock means along with the piston and its associated seals to lock the wiper and operating string together to prevent premature release by mechanical forces. In the FIGS. 2 and 3 form, the lock means 15 can only be actuated hydraulically.

The lock means 15 of the invention shown the FIG. 1, as a practical matter with present technology, is preferably actuated hydraulically; however, a string of small pipe, or sucker rods could be lowered into the operating string from the earth's surface to engage the seat 24 of the piston P and mechanically actuate the lock means 15 and shear the pin 23 to release wiper 10 from the operating string tail pipe 4.

The foregoing disclosure and description of the invention are illustrative and explanatory thereof, and various changes in size, shape and materials as well as in the details of the illustrated construction may be made without departing from the spirit of the invention.

What is claimed is:

1. Apparatus for use with an operating string having a bore to conduct a substance to a well bore comprising:

a tubular wiper including a wiper body having a longitudinal bore therethrough and annular, resilient ribs extending outwardly from said wiper body;

piston means between said wiper body and the operating string;

cooperative engaged surfaces forming lock means to releasably secure said piston means between said wiper body and the operating string;

said piston means having one end recessed and overlapping said engaged surfaces; and releasable means connected to said piston means to secure said piston means end in overlapped relation with said engaged surfaces to prevent relative longitudinal movement between said wiper body and the operating string.

2. The apparatus of claim 1 including port means to equalize pressure in the well bore with the other end of said piston means.

3. The apparatus of claim 1 including:

plug means including a body having annular resilient ribs extending outwardly from said plug body to engage and wipe the tubular operating string behind the substance as the substance is conducted through the tubular operating string;

cooperating seat means in the bore of said operating string and on said plug body to seat said plug means in said wiper body; and cooperating seals on said plug body and between said wiper body and the operating string to close off communication between the bore of the operating string and the well bore when said plug means is seated in the wiper body whereby pressure in the operating string releases said releasable means whereupon said piston means end moves so that said engaged surfaces disengage to accommodate relative longitudinal movement between said wiper body and the operating string.

4. The apparatus of claim 2 including:

plug means including a body having annular resilient ribs extending outwardly from said plug body to engage and wipe the tubular operating string behind the substance as the substance is conducted through the tubular operating string;

cooperating seat means in the bore of said operating string and on said plug means to seat said plug body in said wiper body; and cooperating seals on said plug body and between said wiper body and the operating string to close off communication between the bore of the operating string and the well bore when said plug means is seated adjacent the lower end of the tubular operating string whereby pressure in the operating string releases said releasable means whereupon said piston means end moves so that said engaged surfaces disengage to accommodate relative longitudinal movement between said wiper body and the operating string.

5. The apparatus of claim 1 wherein said engaged surfaces releasably lock said piston means within the bore of said wiper body.

6. The apparatus of claim 2 wherein said engaged surfaces releasably lock said piston means within the bore of said wiper body.

7. The apparatus of claim 3 wherein said engaged surfaces releasably lock said piston means within the bore of said wiper body.

8. The apparatus of claim 1 wherein said engaged surfaces releasably lock said piston means within the bore of the operating string.

9. The apparatus of claim 2 wherein said engaged surfaces releasably lock said piston means within the bore of the operating string.

10. The apparatus of claim 3 wherein said engaged means releasably lock said piston means within the bore of the operating string.

11. The apparatus of claim 1 wherein said engaged surfaces include:

an annular recess on the operating string adjacent the wiper body; and a projection engaging in the operating string recess.

12. The apparatus of claim 2 wherein said interlocking surfaces include:
an annular recess on the operating string adjacent the wiper body; and
a projection engaging in the operating string recess.

13. The apparatus of claim 3 wherein said engaged surfaces include:
an annular recess on the operating string adjacent the wiper body; and
a projection engaging in the operating string recess.

14. The apparatus of claim 1 wherein said engaged surfaces include:
an annular recess on the wiper body adjacent the operating string; and
a projection engaging in the wiper body recess.

15. The apparatus of claim 2 wherein said engaged surfaces include:
an annular recess on the wiper body adjacent the operating string; and
a projection engaging in the upper body recess.

16. The apparatus of claim 3 wherein said engaged surfaces include:
an annular recess on the wiper body adjacent the operating string; and
a projection engaging in the upper body recess.

17. The apparatus of claim 2 wherein said piston means includes seals sealably engaging between the operating string and said wiper body and wherein the port means which equalizes well bore fluid pressure with the other end of said piston means is in the operating string.

18. The apparatus of claim 4 wherein said piston means includes seal means sealably engaging said wiper body and seat means for receiving said plug means, said plug means having seal means to sealably engage said seat means and wherein the port means which equalizes well bore fluid pressure with one end of said piston is in said wiper body.

19. The apparatus of claim 1 wherein said releasable means connected to said piston means to secure said piston means comprises split ring means extending between said operating string and said piston means to accommodate relative rotation therebetween.

20. The apparatus of claim 3 wherein said seat means for said plug means is formed on said piston means and wherein said cooperating seals include a seal on said plug body to sealably engage with said piston.

21. The apparatus of claim 1 wherein said releasable means connected to said piston means to secure said piston means comprises shear means connected between said wiper body and said piston means to accommodate relative rotation therebetween.

22. The apparatus of claim 2 wherein the port means which equalizes well bore fluid pressure with the other end of said piston means is in said wiper body.

23. The apparatus of claims 5, or 6, or 7 wherein said releasable means which is connected to said piston means is responsive solely to pressure from the operating string acting on said piston means to release said piston means for longitudinal movement to unlock said lock means and release said wiper means from the operating string.

24. The apparatus of claims 5, or 6, or 7 wherein said releasable means comprises cooperating surface means on said wiper body and said piston means and wherein said lock means comprises cooperating surface means on said operating string and said piston means to accommodate relative rotation between said wiper body and said operating string, said piston means responsive soley to pressure from the operating string to actuate said releasable means and lock means for longitudinal movement of said wiper means relative to the operating string.

25. The apparatus of claims 8, or 9, or 10 wherein said releasable means comprises cooperating surface means on said operating string and said piston means and wherein said lock means comprises cooperating surface means on said wiper body and said piston means to accommodate relative rotation between said operating string and said piston means and between said wiper body and said piston means, said piston means responsive solely to pressure from the operating string to actuate said releasable means and lock means for longitudinal movement of said wiper means relative to the operating string.

26. The apparatus of claims 8, or 9, or 10 wherein said piston means is releasably supported in the bore of the operating string by shear means connected and between said operating string and said piston means between said operating string and said piston means to accommodate relative rotation therebetween.

27. In a method of conducting a substance to a well bore through an operating string having a bore for conducting the substance into the well bore and wherein a pump down plug is moved through the operating string behind the substance comprising the steps of:
positioning a single wiper with a longitudinal bore on the operating string to sealably engage the operating string;
positioning a piston between the operating string and wiper to sealably engage the wiper;
releasably connecting the piston between the operating string and the wiper;
locking the piston between the operating string and wiper for manipulation of the operating string without effecting premature release of the wiper;
inserting the pump down plug in the operating string and pumping it down the operating string;
sealably seating the plug in the single wiper bore to cooperate with the sealably positioned wiper and operating string for confining fluid pressure in the operating string to act on the piston;
increasing the pressure in the operating string to unlock the piston from the between the operating string and the wiper; and
discharging the substance into the well bore.

28. A method of conducting a substance to a well bore through an operating string having a bore for conducting the substance into the well bore comprising the steps of:
sealably positioning a single wiper and the operating string to seal off communication from the operating string to externally of the wiper adjacent the location of the wiper on the operating string;
positioning a piston in sealing relationship with the wiper;
releasably connecting the piston to the operating string;
locking the piston to the operating string and wiper for manipulation of the operating string without effecting premature release of the wiper;
discharging a first liquid barrier into the operating string followed by the substance and a second liquid barrier behind the substance;

inserting a pump down plug in the operating string behind the second liquid barrier and pumping it, the second barrier, the substance and first barrier down the operating string;

sealably seating the plug in the single wiper to cooperate with the sealably positioned wiper and operating string for confining fluid pressure in the operating string to act on the piston;

increasing the pressure in the operating string to unlock the piston from the operating string; and discharging the substance into the well bore.

29. A method of conducting a substance to a well bore through an operating string having a bore for conducting the substance into the well bore comprising the steps of:

sealably positioning a single wiper and the operating string to seal off communication from the operating string to externally of the wiper adjacent the location of the wiper on the operating string;

positioning a piston sealably between the operating string and wiper;

releasably connecting the piston to the wiper;

locking the piston means to the operating string and wiper for manipulation of the operating string without effecting premature release of the wiper;

discharging a first liquid barrier into the operating string followed by the substance and a second liquid barrier behind the substance;

inserting a pump down plug in the operating string behind the second liquid barrier and pumping it, the second barrier, the substance and first barrier down the operating string;

sealably seating the plug in the piston to cooperate with the sealably positioned wiper and operating string for confining fluid pressure in the operating string to act on the piston;

increasing the pressure in the operating string to unlock the piston from between the operating string and the wiper; and discharging the substance into the well bore.

30. A method of preparing an assembly for conducting and discharging a substance through an operating string bore to a selected region in a well bore comprising the steps of:

sealably positioning a wiper adjacent the lower end of the operating string with a piston between the operating string and wiper, the piston having a seal to seal with the wiper;

providing an internal annular seat on the piston for seating a pump down plug on the piston, the pump down plug also including seals for sealing with the piston and with the wiper below the seat on the piston for confining operating string fluid pressure to act on the piston;

releasably connecting the piston between the wiper and the operating string; and locking the piston with the operating string and the wiper whereby fluid pressure in the operating string bore acts on the piston and plug seated thereon and sealed therewith to unlock the piston from the operating string and wiper for movement of the wiper and discharge of the substance into the well bore.

31. A method of preparing an assembly for conducting and discharging a substance through an operating string bore to a selected region in a well bore comprising the steps of:

sealably positioning a wiper adjacent the lower end of the operating string with a piston and seal means sealably engaging between the operating string and piston and between the piston and the wiper;

releasably connecting the wiper to the operating string;

locking the piston in sealed position between the wiper and the operating string;

providing a port in the operating string for communicating fluid pressure from the operating string to the piston to unlock the wiper from the operating string; and spacing seals from each end of the piston to seal between the wiper and operating string.

32. A method of preparing an assembly for conducting and discharging a substance through an operating string bore to a selected region in a well bore comprising the steps of:

sealably positioning a wiper adjacent the lower end of the operating string with a piston and seal means sealably engaging between the operating string and piston and between the piston and the wiper;

locking the piston in sealed position between the wiper and the operating string; and providing a port in the wiper to conduct fluid pressure from the operating string to the piston to unlock the wiper from the operating string.

33. A method of preparing an assembly for conducting and disharging a substance through an operating string bore to a selected region in a well bore comprising the steps of:

sealably positioning a wiper adjacent the lower end of the operating string with a piston and seal means sealably engaging between the operating string and piston and between the piston and the wiper;

releasably connecting the wiper to the operating string, locking the piston in sealed position between and with the wiper and the operating string;

providing a port in operating string for communicating fluid pressure from the operating string to unlock the wiper from the operating string; and retrieving the piston with the operating string.

34. The method of claim 27 including the step of forming the releasable connection between the wiper and the operating string to accommodate relative rotation between the operating string and wiper without effecting release of the wiper.

35. The method of claim 28 including the step of forming the releasable connection between the wiper and the operating string to accommodate relative rotation between the operating string and wiper without effecting release of the wiper.

36. The method of claim 29 including the step of forming the releasable connection between the wiper and the operating string to accommodate relative rotation between the operating string and wiper without effecting release of the wiper.

37. The method of claim 30 including the step of forming the releasable connection between the wiper and the operating string to accommodate relative rotation between the operating string and wiper without effecting release of the wiper.

38. Apparatus for use with a tubular operating string with a bore to conduct a substance to a well bore tubular member to a well bore comprsing:

a tubular wiper including a body having a longitudinal bore therethrough and annular, resilient ribs extending outwardly from said body;

means to releasably secure said wiper body to the operating string adjacent the lower open end of the tubular operating string;

lock means, including a piston to lock said wiper to the operating string against release by manipulation of the tubular operating string; and a pump down plug to seat in said piston, said pump down plug having seal means to seal with said piston and seal means to seal within said wiper body bore below said seat, to confine fluid pressure in the operating string to act on said piston and release said lock means.

* * * * *